US010348034B1

(12) United States Patent
Chang et al.

(10) Patent No.: US 10,348,034 B1
(45) Date of Patent: Jul. 9, 2019

(54) ELECTRICAL CONNECTOR ASSEMBLY

(71) Applicant: LOTES CO., LTD, Keelung (TW)

(72) Inventors: Wen Chang Chang, Keelung (TW); Si Nai Peng, Keelung (TW); Hua Yin Dai, Keelung (TW); Wang Cheng Shen, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/118,773

(22) Filed: Aug. 31, 2018

(30) Foreign Application Priority Data

Dec. 20, 2017 (CN) ..... 2017 1 1379632

(51) Int. Cl.

| | |
|---|---|
| ***H01R 13/627*** | (2006.01) |
| ***H01R 13/6581*** | (2011.01) |
| ***H01R 13/502*** | (2006.01) |
| ***H01R 24/38*** | (2011.01) |
| ***H01R 24/62*** | (2011.01) |
| ***H01R 13/639*** | (2006.01) |
| ***H01R 13/15*** | (2006.01) |

(Continued)

(52) U.S. Cl.

CPC ..... *H01R 13/6272* (2013.01); *H01R 13/15* (2013.01); *H01R 13/502* (2013.01); *H01R 13/639* (2013.01); *H01R 13/6581* (2013.01); *H01R 13/6593* (2013.01); *H01R 24/38* (2013.01); *H01R 24/62* (2013.01); *H01R 2103/00* (2013.01); *H01R 2201/26* (2013.01)

(58) Field of Classification Search

CPC .. H01R 13/6272; H01R 13/639; H01R 13/15; H01R 24/62; H01R 13/502; H01R 13/6581; H01R 13/6593; H01R 24/38; H01R 2103/00; H01R 2201/26

USPC ..... 439/352, 350, 357, 358

See application file for complete search history.

(56) References Cited

U.S. PATENT DOCUMENTS 6,332,800 B2 * 12/2001 Kodama ..... H01R 13/6273 439/357

6,997,749 B1 * 2/2006 Harubayashi ..... H01R 13/506 439/353

(Continued)

FOREIGN PATENT DOCUMENTS

| | | |
|---|---|---|
| CN | 201893470 U | 7/2011 |
| CN | 102132465 B | 10/2013 |
| CN | 206290541 U | 6/2017 |

*Primary Examiner* — Abdullah A Riyami

*Assistant Examiner* — Nelson R. Burgos-Guntin

(74) *Attorney, Agent, or Firm* — Locke Lord LLP; Tim Tingkang Xia, Esq.

(57) ABSTRACT

An electrical connector assembly includes a first connector and a second connector inserted to a front of the first connector. The second connector has a casing. A latch portion is protrudingly provided above the casing. The first connector includes a shell. A locking arm is pivoted to the shell by a pivoting portion, and is provided with a buckling portion for buckling the latch portion. The locking arm includes at least one first position limiting portion and a second position limiting portion in front of the buckling portion. In a separation process of the first and second connectors, the locking arm is actuated, the buckling portion is detached from the latch portion and moves backward, and the latch portion firstly stops the first position limiting portion. After the latch portion is detached from the first position limiting portion, the latch portion stops the second position limiting portion from moving backward.

13 Claims, 14 Drawing Sheets

(51) Int. Cl.
*H01R 13/6593* (2011.01)
*H01R 103/00* (2006.01)

(56) References Cited

U.S. PATENT DOCUMENTS

| | | | | |
|---|---|---|---|---|
| 7,850,476 | B2 * | 12/2010 | Good | H01R 13/639 136/251 |
| 8,602,809 | B2 * | 12/2013 | Kyoyama | H01R 13/6395 439/358 |
| 8,641,442 | B2 * | 2/2014 | Svelnis | H01R 13/6275 439/358 |
| 8,784,126 | B2 * | 7/2014 | Chang | H01R 13/6395 439/358 |
| 2002/0090856 | A1 * | 7/2002 | Weisz-Margulescu | H01R 13/6273 439/358 |
| 2007/0020986 | A1 * | 1/2007 | Fry, Jr. | H01R 13/6272 439/357 |
| 2015/0093927 | A1 * | 4/2015 | Morello | H01R 13/6272 439/352 |
| 2015/0270644 | A1 * | 9/2015 | Marsh | H01R 13/6273 439/347 |

* cited by examiner

A-A

ELECTRICAL CONNECTOR ASSEMBLY

CROSS-REFERENCE TO RELATED PATENT APPLICATION

This non-provisional application claims priority to and the benefit of, pursuant to 35 U.S.C. § 119(a), patent application Serial No. CN201711379632.3 filed in China on Dec. 20, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector assembly, and more particularly to an electrical connector assembly for transmitting high-voltage high current.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

As is known to all, the use of a high-voltage high current electrical connector assembly is becoming increasingly popular nowadays, and is especially more indispensable in new energy electric vehicles. However, if a power supply terminal of a plug and receptacle is suddenly separated by an operator when transmitting a high-voltage high current, a high-voltage arc can be very easily generated at the tail end of the terminal, and can burn out other electronic components and even cause an electric shock to the operator, resulting in potential safety hazards of the use of an electronic device. In order to solve this problem, an electrical connector assembly has been invented based on power cut before separation to avoid the high-voltage arc. For example, the Chinese Patent No. CN200980130884.X discloses a high current electrical connector assembly, which includes a connector and a corresponding mating connector. The connector includes an actuating arm hinged on a shell of the connector. A front end of the actuating arm has a locking surface, and both sides of the locking surface respectively extend to form two guiding members. A back end of the actuating arm has a ribbed surface. Once the ribbed surface is pressed down, the front end of the actuating arm will move upward. A shell of the mating connector is protrudingly provided with a first locking nose and a second locking nose which are separate in a front-rear direction. The shell of the connector is also provided with a guiding mechanism which is symmetrically provided in a left-right direction. The first locking nose interacts with the locking surface so as to lock the connector and the mating connector to a first locking position. At this time, the connector is completely inserted into the mating connector, the connector is connected with a power supply terminal in the mating connector, and a signal terminal is connected. When an operator presses down the actuating arm on the ribbed surface, the locking surface moves upward to be above the first locking nose, and the connector and the mating connector are unlocked. When the operator continues to pull the connector back, the guiding members will contact an inclined surface of the guiding mechanism, and the guiding mechanism presses the guiding members downward, such that the locking surface automatically contacts the second locking nose. At this time, the second locking nose interacts with the locking surface so as to lock the connector and the mating connector to a second locking position, and the connector is connected with the power supply terminal of the mating connector, but the signal terminal is disconnected. When the signal terminal is disconnected, the control equipment receives a system power cut command so as to cut off power of the power supply terminal. Furthermore, the ribbed surface is pressed, and the locking surface moves upward to be above the second locking nose, such that the connector can be completely drawn out of the mating connector, thereby cutting off a signal and main circuit current in different stages, and avoiding the generation of high-voltage arc.

In a separation process of the connector and the mating connector, the stroke length of the connector is limited, and the separation speed of the connector and the mating connector is faster. However, after the second locking nose is separated from the locking surface, the connector and the mating connector can be quickly separated. Therefore, it must be required that the control equipment should receive the signal terminal power-cut information and control the power cut of the power supply terminal while the second locking nose is being stopped to the locking surface. As a result, it is inevitable that a control device will work unstably due to over-short reaction time, so it is impossible to ensure a power cut before the connector is separated from the power supply terminal of the mating connector every time the connector is separated from the mating connector, thereby causing a risk of the generation of the high-voltage arc when the connector is separated from the power supply terminal of the mating connector.

Therefore, a heretofore unaddressed need to design an improved electrical connector assembly exists in the art to address the aforementioned deficiencies and inadequacies.

SUMMARY

In view of the above deficiencies in the background, the invention is directed to an electrical connector assembly which steadily ensures the separation of terminals of an electrical connector and a mating member of a mating connector without current.

To achieve the foregoing objective, the invention adopts the following technical solutions: an electrical connector assembly includes a first connector and a second connector inserted to a front of the first connector. The second connector has a casing, and a latch portion is protrudingly provided above the casing. The first connector includes a shell, a pivoting portion is disposed on the shell, a locking arm is pivoted to the shell by the pivoting portion, the locking arm is provided with a buckling portion in front of the pivoting portion, the latch portion is buckled with the buckling portion, and the locking arm includes at least one first position limiting portion and a second position limiting portion in front of the buckling portion. In a separation process of the first connector and the second connector, the locking arm is actuated, the buckling portion is detached from the latch portion and moves backward, and the latch portion firstly stops the first position limiting portion; and after the latch portion is detached from the first position limiting portion, the latch portion stops the second position limiting portion from moving backward.

In certain embodiments, in a vertical direction, the first position limiting portion is positioned below the second position limiting portion.

In certain embodiments, the buckling portion is a buckling slot on the locking arm, the second position limiting portion is another buckling slot provided in front of the buckling portion, a first beam is provided between the buckling portion and the second position limiting portion, and a second beam is provided at a front end of the second position limiting portion.

In certain embodiments, the locking arm protrudingly extends downward from a left side and a right side of the second position limiting portion to form two first position limiting portions; in a front-rear direction, the two first position limiting portions are located between the first beam and the second beam; and the two first position limiting portions respectively have engaging blocks protrudingly extend toward each other, and in the separation process of the first connector and the second connector, the latch portion stops the two engaging blocks.

In certain embodiments, projections of the two engaging blocks along a vertical direction overlap with a projection of the second position limiting portion along the vertical direction.

In certain embodiments, the latch portion includes a main body portion and two stopping portions extending symmetrically from two sides of the main body portion, and in the separation process of the first connector and the second connector, the two stopping portions respectively stop the two engaging blocks.

In certain embodiments, in a left-right direction, a width of the main body portion is less than a distance between the two engaging blocks, and a distance between the two stopping portions is greater than the distance between the two engaging blocks.

In certain embodiments, a top end of the main body portion is flush with top ends of the two stopping portions.

In certain embodiments, the casing is concavely provided with two sliding slots respectively at a left side and a right side of the main body portion, the two sliding slots extend to a back end surface of the casing, and the two stopping portions are respectively located above the two sliding slots.

In certain embodiments, a bottom of each of the first beam and the second beam has an inclined surface gradually tilting downward from front to back, and a top of the latch portion is provided with at least one guiding inclined surface gradually tilting downward from front to back.

In certain embodiments, an operational key is installed at a back end of the locking arm, at least one spring is fastened between the operational key and the locking arm, and a torsion spring is sleeved over the pivoting portion and simultaneously abuts the locking arm and the shell.

In certain embodiments, a shielding ring is sleeved over the casing, the shielding ring is provided with a plurality of holes and a plurality of elastic sheets, and the elastic sheets are extended radially outward to abut an external member.

In certain embodiments, the second position limiting portion and the buckling portion are located on a same horizontal plane.

Compared with the related art, certain embodiments of the invention have the following beneficial effects:

In the separation process of the first connector and the second connector, the locking arm is actuated, the buckling portion is detached from the latch portion and moves backward, and the latch portion firstly stops the first position limiting portion; and after the latch portion is detached from the first position limiting portion, the latch portion stops the second position limiting portion from moving backward. Thus, the first connector is prevented from being quickly separated from the second connector after the locking arm is detached from the first position limiting portion, ensuring the control equipment to have sufficient time to receive a power cut signal and control the power cut of the terminal and a mating terminal, enhancing the working stability of the control equipment, and further ensuring the terminal and the mating terminal to be in a no-current state when the first connector and the second connector are completely separated, thereby avoiding the risk of the generation of a high-voltage arc by the electrical connector assembly.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
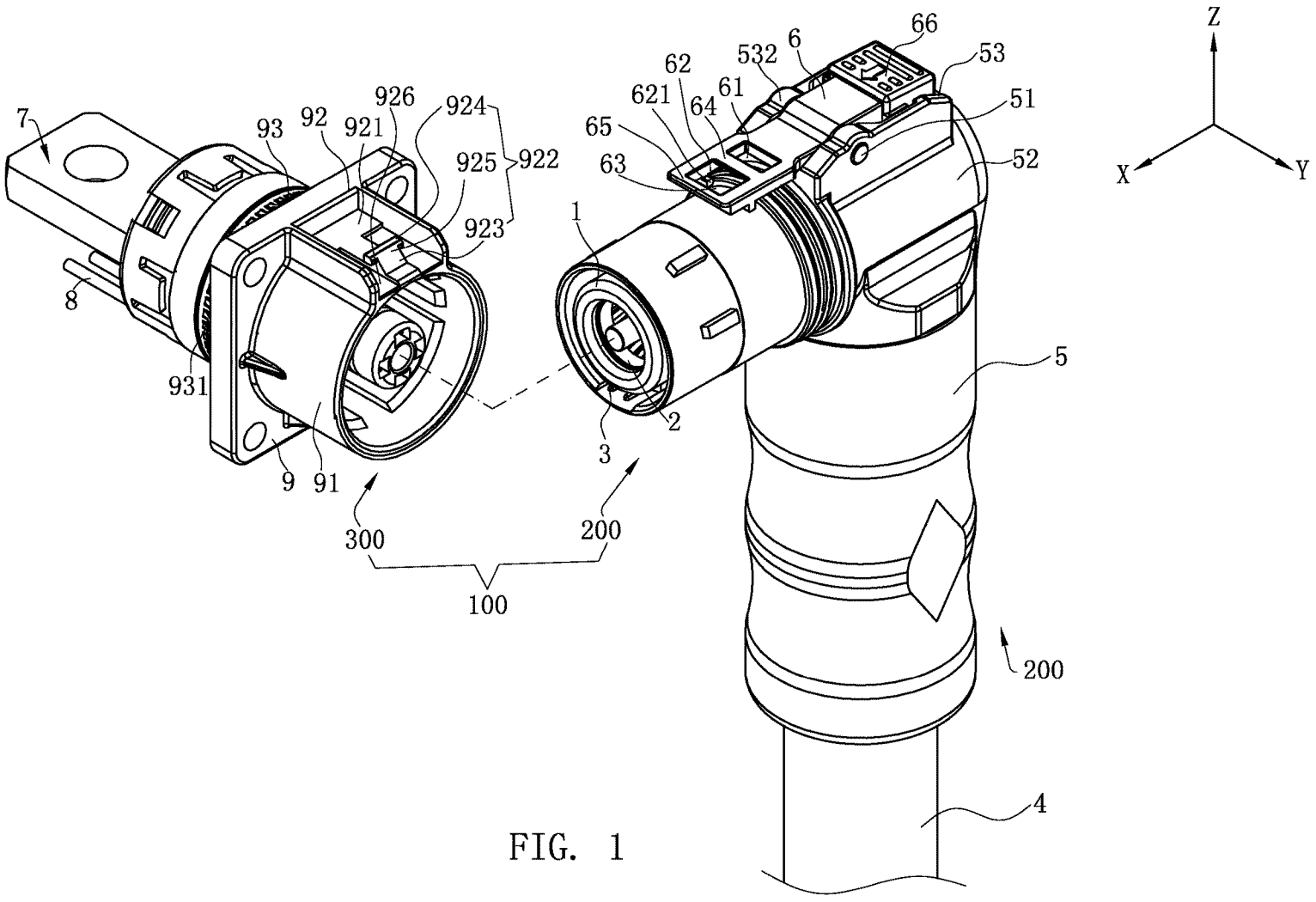
FIG. 1 is a perspective view of an electrical connector assembly according to a first embodiment of the present invention, before a first connector and a second connector are mated.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-14. In accordance with the purposes of this invention, as embodied and broadly described herein, this invention, in one aspect, relates to a test electrical connector assembly.

Figure 2:
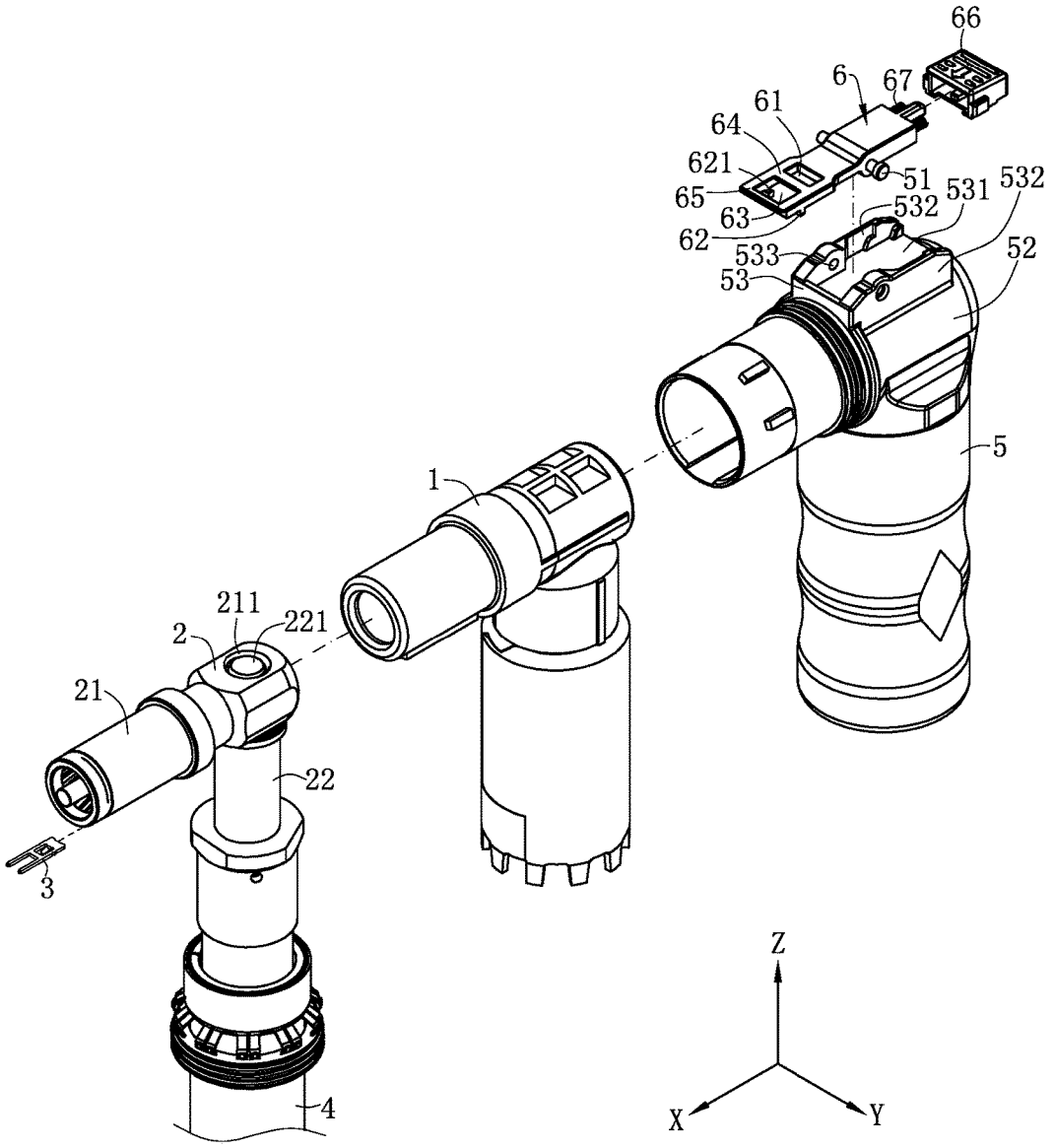
FIG. 2 is a perspective exploded view of the first connector of the electrical connector assembly according to the first embodiment of the present invention.
Figure 6:
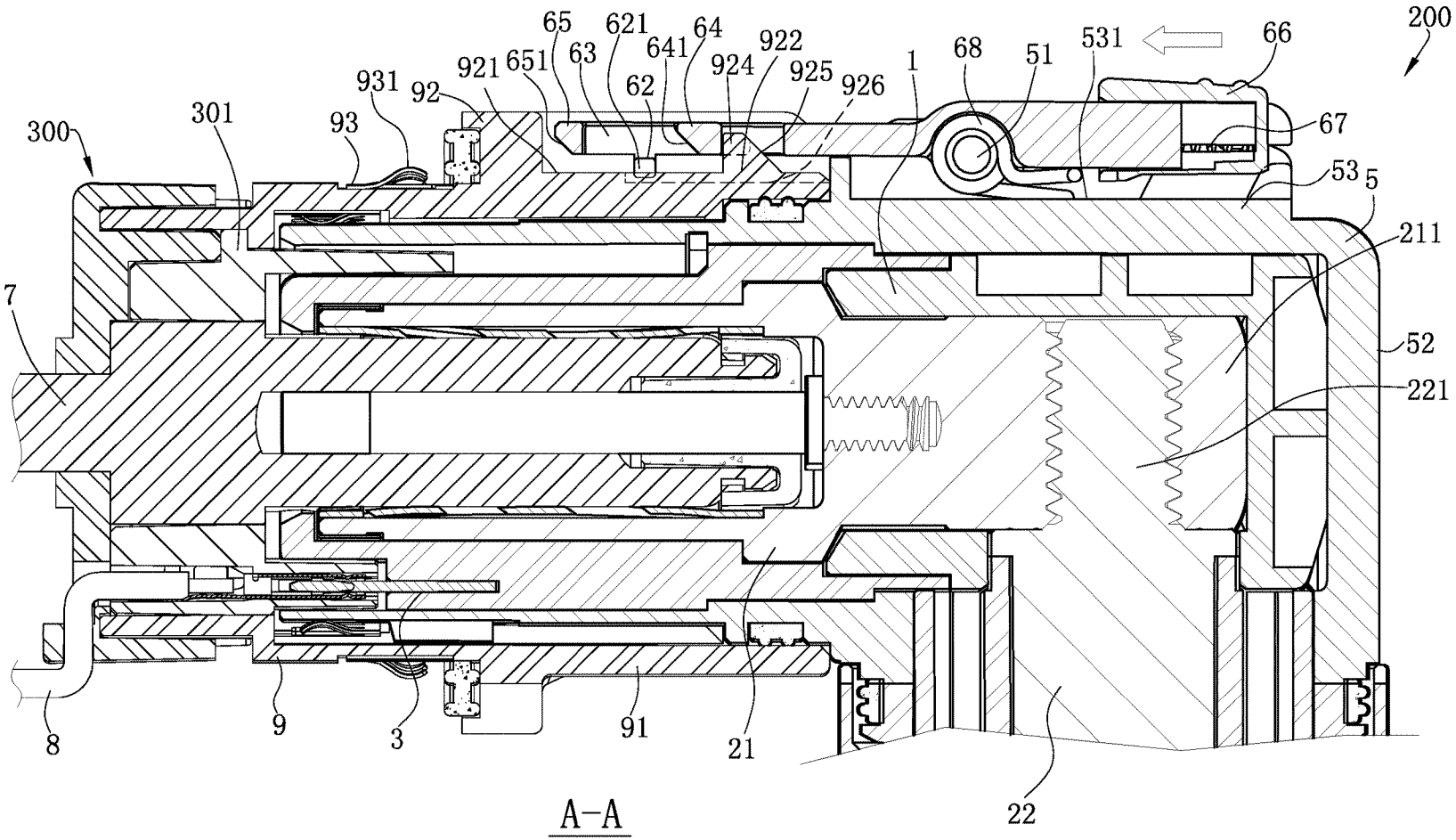
FIG. 6 is a partial sectional view of the electrical connector assembly according to the first embodiment of the present invention, after the first connector is inserted into the second connector.

FIG. 1, FIG. 2 and FIG. 6 show an electrical connector assembly 100 according to a first embodiment of the present invention. For convenience of understanding, as shown in a three-dimensional coordinate system in FIG. 1, the axis X denotes a forward direction, the axis Y denotes a direction toward the right, and the axis Z denotes an upward direction. The left-right direction in this embodiment is a transverse direction. The electrical connector assembly 100 includes a first connector 200 and a second connector 300 which is mated at a front of the first connector 200. The first connector 200 includes an insulating body 1, a terminal 2 and a detection sheet 3 accommodated in the insulating body 1, a shell 5 covering the insulating body 1, a pivoting portion 51 disposed on the shell 5, a locking arm 6 pivoted to a top portion of the shell 5 by the pivoting portion 51, and a cable 4 soldered to a rear end of the terminal 2. The second connector 300 includes a plastic main body 301, a mating terminal 7 and a signal wire 8 accommodated in the plastic main body 301, and a casing 9 covering on the plastic main body 301, accommodating the shell 5 and fastening the locking arm 6, such that the first connector 200 is steadily inserted into the second connector 300.

Figure 3:
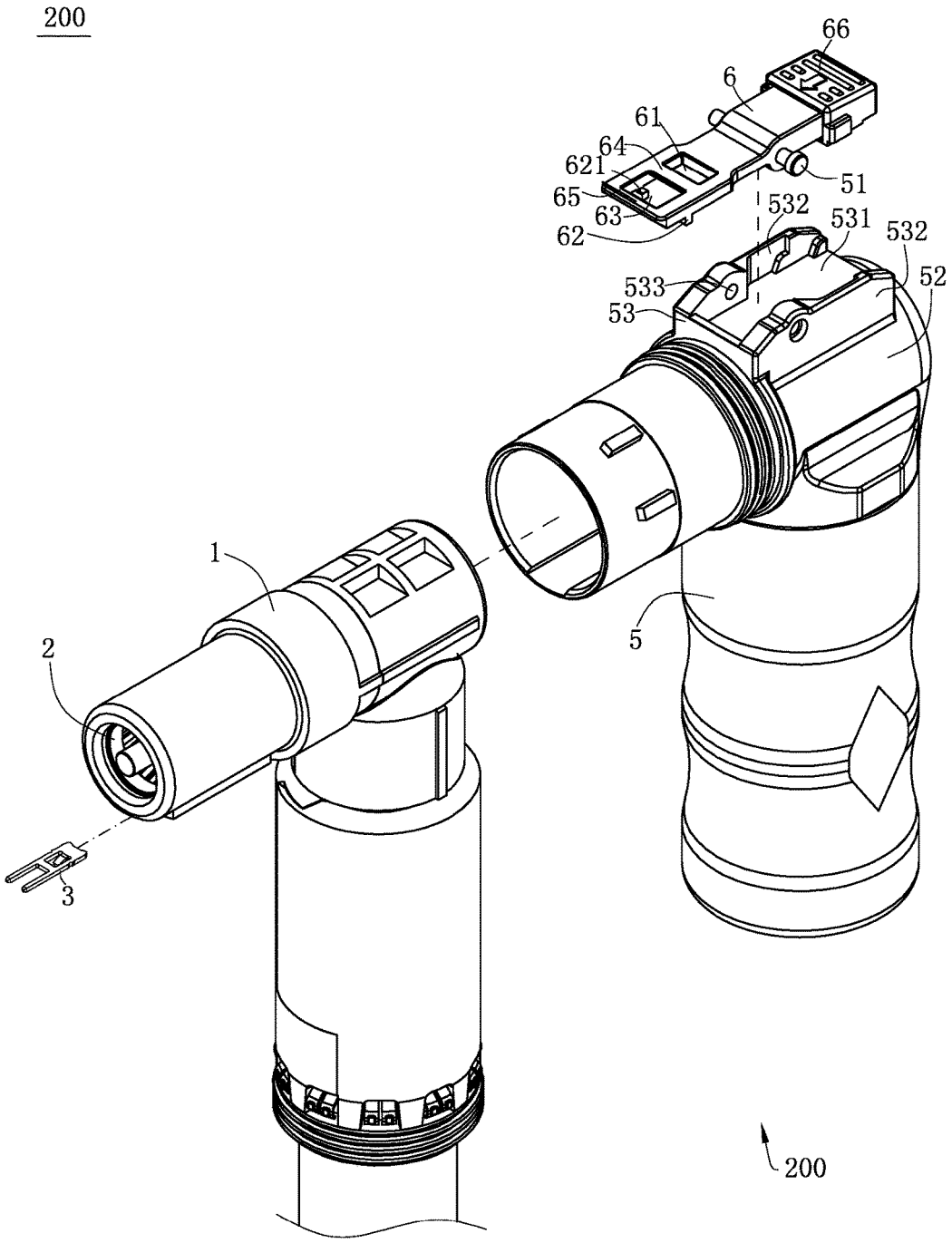
FIG. 3 is a perspective exploded view of the electrical connector assembly according to the first embodiment of the present invention, after the terminal is sleeved into the insulating body.
Figure 4:
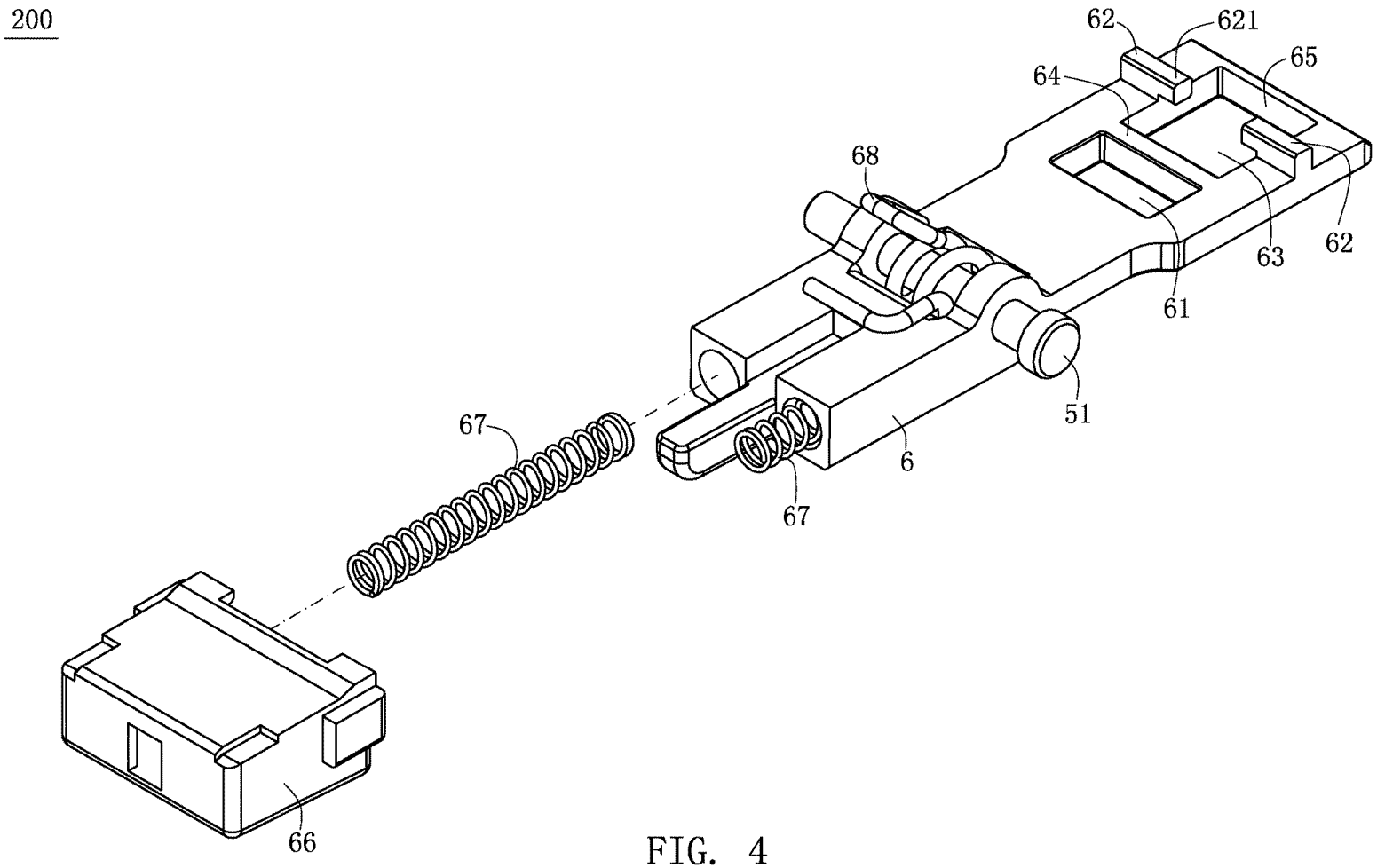
FIG. 4 is a perspective view of a locking arm, an operational key, springs, a torsion spring and a pivoting portion of the electrical connector assembly according to the first embodiment of the present invention.

As shown in FIG. 3 and FIG. 4, the shell 5 is integrally formed with a metal material, and the shell 5 includes a main body portion 52 and a mounting base 53 located at a top end of the main body portion 52. The mounting base 53 includes an accommodating cavity 531 concavely formed from top to bottom, and two sides walls 532 located at the left and right ends of the accommodating cavity 531. The accommodating cavity 531 is used for accommodating the back end of the locking arm 6. Each of the two side walls 532 is respectively provided with a pivoting hole 533, and a pivoting portion 51 is fixed to the mounting base 53 through the pivoting holes 533. The locking arm 6 is pivoted to the top of the mounting base 53 by the pivoting portion 51. The locking arm 6 is provided with a buckling portion 61 in front of the pivoting portion 51, and the locking arm 6 includes at least one first position limiting portion 62 and a second position limiting portion 63 in front of the buckling portion 61. Each of the buckling portion 61 and the second position limiting portion 63 is a square-shaped buckling slot which penetrates through the upper and lower surfaces of the locking arm 6. The second position limiting portion 63 and the buckling portion 61 are located on a same horizontal plane. When the first connector 200 and the second connector 300 are completely mated, the buckling portion 61 fastens the casing 9 to prevent the second connector 300 from falling off. A first beam 64 is provided between the buckling portion 61 and the first position limiting portions 62, and a bottom of the first beam 64 has a first inclined surface 641 which gradually tilts downward from the front to back. A second beam 65 is provided at a front end of the second position limiting portion 63, and a bottom of the second beam 65 has a second inclined surface 651 which gradually tilts downward from the front to back. The locking arm 6 protrudingly extends downward respectively from the left and right sides of the second position limiting portion 63 to form two first position limiting portions 62, such that the two first position limiting portions 62 are symmetrically provided in a left-right direction, thereby facilitating the structural balance of the locking arm 6. The two first position limiting portions 62 protrudingly extend toward a symmetrical plane thereof to respectively form two engaging blocks 621. In a separation process of the first connector 200 and the second connector 300, the engaging blocks 621 perform the function of temporarily stopping the casing 9. In a front-rear direction, the buckling portion 61, the first beam 64, the first position limiting portions 62 and the second beam 65 are sequentially provided on the locking arm 6 from back to front. In the vertical direction, projections of the two engaging blocks 621 overlap with a projection of the second position limiting portion 63.

An operational key 66 is sleeved over a back end of the locking arm 6, and a top portion of the operational key 66 is provided with a pressing surface having multiple ribs, such that a user can conveniently push and press down the operational key 66. The locking arm 6 is in a horizontal state at the beginning. Once the operational key 66 is actuated downward, the back end of the locking arm 6 swings downward, and the front end of the locking arm 6 moves upward under the lever action of the pivoting portion 51. Further, two springs 67 which are symmetrically provided in the left-right direction are fastened between the locking arm 6 and the operational key 66, and provide elastic restoring forces for the forward and backward movement of the operational key 66 relative to the locking arm 6. Meanwhile, a torsion spring 68 is sleeved over the pivoting portion 51 and is located between the locking arm 6 and the shell 5. The torsion spring 68 simultaneously upward abuts the locking arm 6 and downward abuts the shell 5, and provides an elastic restoring force for the locking arm 6 in a pivoting and swinging process. Once the actuation of the operational key 66 is stopped, by the aid of the elastic restoring forces of the springs 67 and the torsion spring 68, the operational key 66 restores to an initial position, and the locking arm 6 restores to a horizontal state.

Figure 13:
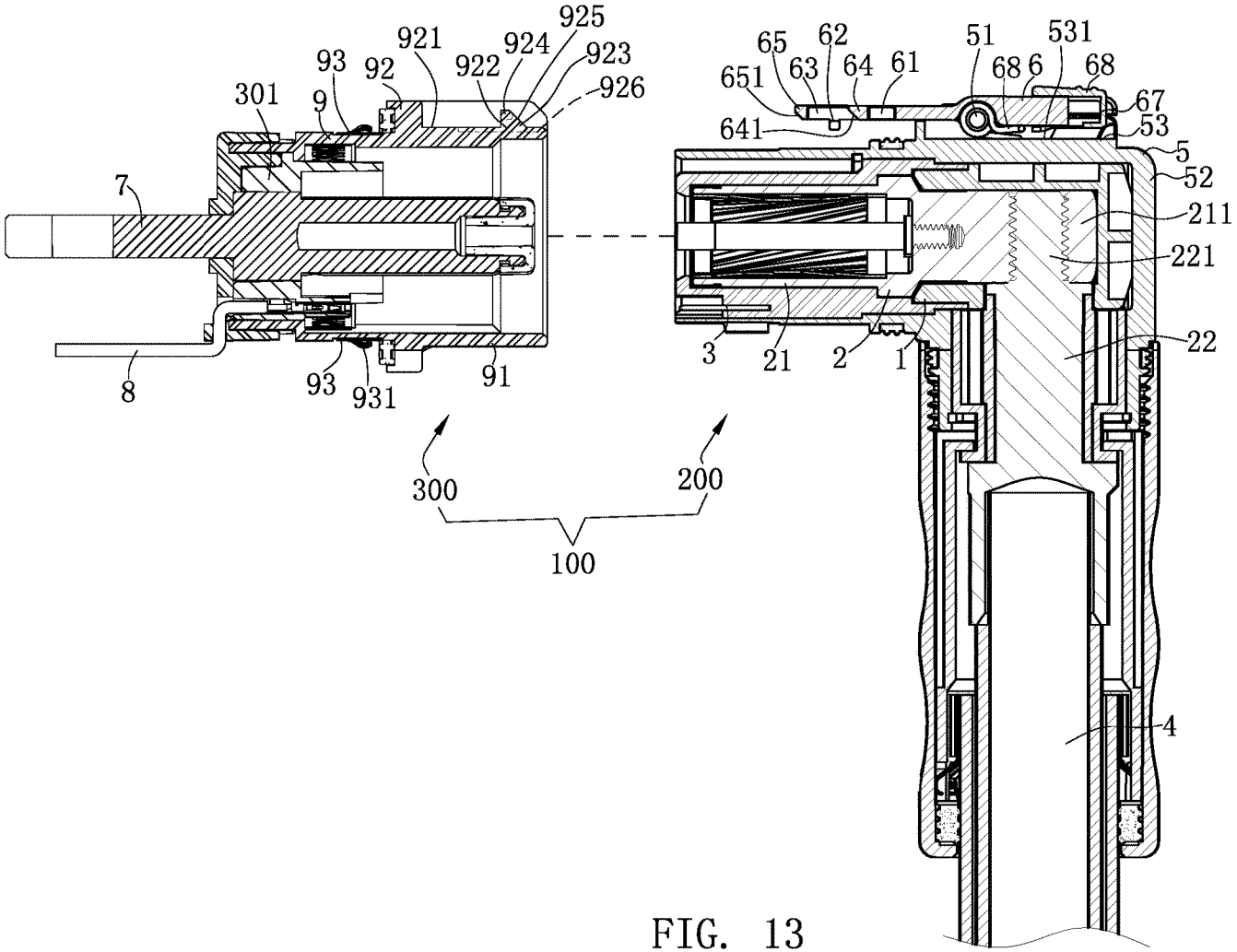
FIG. 13 is a sectional view of the electrical connector assembly according to the first embodiment of the present invention, where the first connector and the second connector are completely separated.

As shown in FIG. 2 and FIG. 13, the terminal 2 includes a horizontal portion 21 and a vertical portion 22. The horizontal portion 21 is provided with a screw hole 211, and the vertical portion 22 has a screw bolt 221 which protrudingly extends upwards. The horizontal portion 21 is fixedly connected with the vertical portion 22 through the screwing of the screw hole 211 and the screw bolt 221, and the cable 4 is connected to the tail end of the vertical portion 22.

Figure 5:
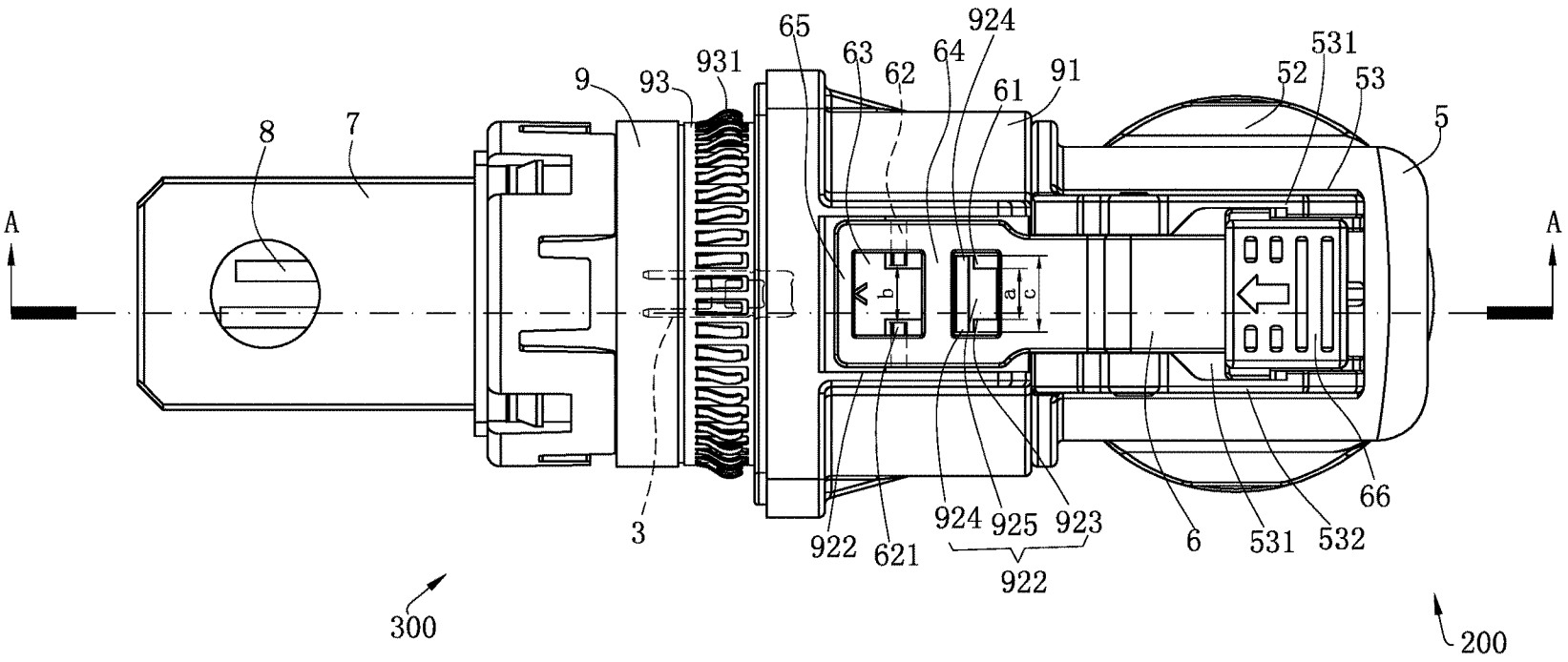
FIG. 5 is a top view of the electrical connector assembly according to the first embodiment of the present invention, after the first connector is inserted into the second connector.

As shown in FIG. 1 and FIG. 5, the casing 9 is integrally formed by a metal material. The casing 9 includes a sleeve 91 and a clamping seat 92 formed by extending upward from the sleeve 91. The sleeve 91 covers the plastic main body 301 and the front end of the shell 5, and the clamping seat 92 accommodates the front end of the locking arm 6. A shielding ring 93 is sleeved over the casing 9. The shielding ring 93 is located at the front end of the clamping seat 92, and is provided with multiple holes and multiple elastic sheets 931. The elastic sheets 931 are formed to extend radially outward to abut an external member (not shown in the drawings).

As shown in FIG. 1, FIG. 5 and FIG. 6, the clamping seat 92 has a bottom plate 921 and protrudingly extends upward to form a latch portion 922, and the latch portion 922 is buckled with the buckling portion 61, such that the first connector 200 is steadily inserted into the second connector 300. The latch portion 922 includes a main body portion 923 and two column-shaped stopping portions 924 which protrudingly extend from the main body portion 923 toward left and right sides. A top end of the main body portion 923 is flush with top ends of the two stopping portions 924. In a left-right direction, a width a of the main body portion 923 is less than a distance b between the two engaging blocks 621, and a distance c between the two stopping portions 924 is greater than the distance b between the two engaging blocks 621. In a vertical direction, a height of each of the stopping portions 924 is greater than a height of each of the engaging blocks 621. The top of the latch portion 922 is provided with a guiding inclined surface 925, which gradually tilts downward from front to back, such that the first inclined surface 641 and the second inclined surface 651 are mated. In addition, the bottom plate 921 is respectively concavely provided with two sliding slots 926 respectively at two sides of the main body portion 923; and the two sliding slots 926 extend to the back end surface of the casing 9 and are used for accommodating the two first position limiting portions 62.

Figure 10:
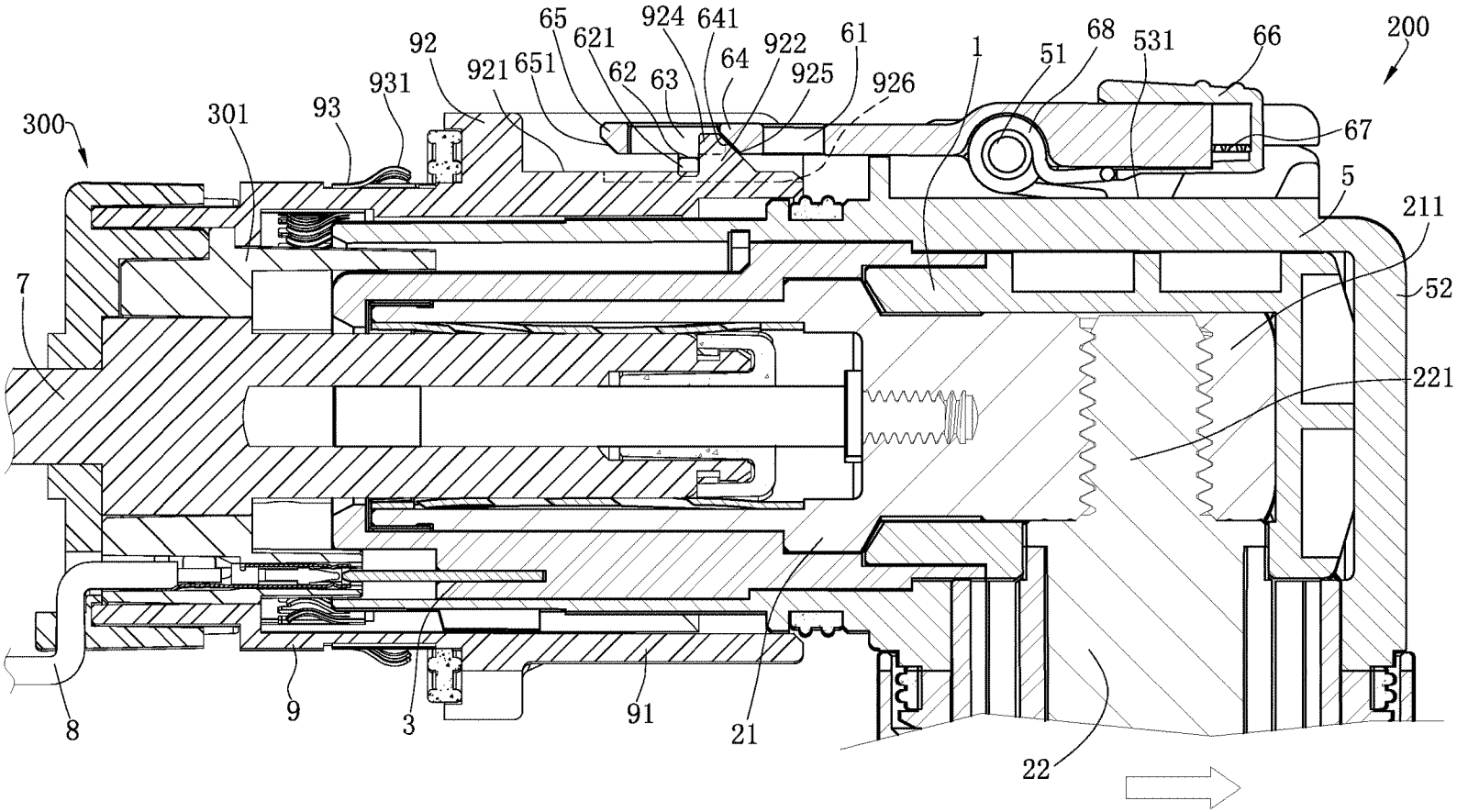
FIG. 10 is a partial sectional view of the electrical connector assembly according to the first embodiment of the present invention, where a first position limiting portion moves downward to detach from the latch portion when the first connector and the second connector are separated.
Figure 11:
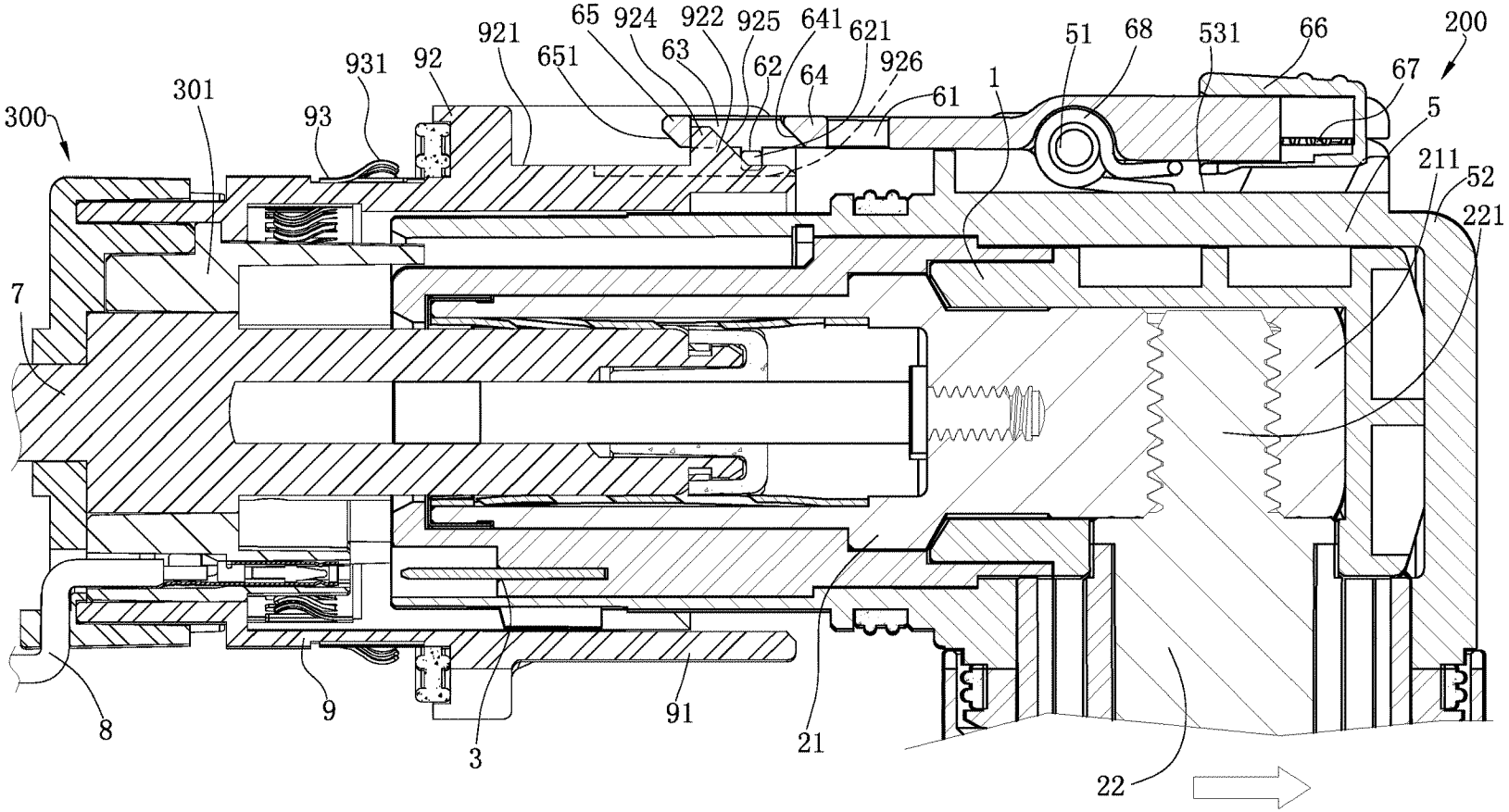
FIG. 11 is a partial sectional view of the electrical connector assembly according to the first embodiment of the present invention, where the latch portion stops a second position limiting portion when the first connector and the second connector are separated.

In a process where the first connector 200 is gradually inserted into the second connector 300, the second inclined surface 651 contacts the guiding inclined surface 925, and the front end of the locking arm 6 gradually moves upward along the guiding inclined surface 925 until the second beam 65 is right across the latch portion 922. Due to the elastic restoring force of the torsion spring 68, the front end of the locking arm 6 swings downward, and the second position limiting portion 63 buckles the latch portion 922. At this time, the terminal 2 and the mating terminal 7 are already in a connection state, and the detection sheet 3 is not connected with the signal wire 8, as shown in FIG. 11. The first connector 200 is continuously pushed forward until the first inclined surface 641 touches the guiding inclined surface 925, as shown in FIG. 10. At this time, the front end of the locking arm 6 moves upward again under the combined actions of the push force and the guiding inclined surface 925 until the first beam 64 is right across the top of the latch portion 922. Under the action of the torsion spring 68, the front end of the locking arm 6 swings downward, such that the buckling portion 61 fastens the latch portion 922; as shown in FIG. 6. At this time, the first connector 200 and the second connector 300 are completely mated, the terminal 2 is connected with the mating terminal 7, and the detection sheet 3 is connected with the signal wire 8. For the convenience of description, this locking position is referred to as a first locking position.

As shown in FIG. 5 and FIG. 6, the first connector 200 and the second connector 300 are in the first locking position. One end of the signal wire 8 is connected with a control equipment (not shown in the drawings, similarly hereinafter), and the other end is connected with the detection sheet 3. The control equipment has a function of controlling the power-on and power-off of the mating terminal 7, and the terminal 2 is steadily connected with the mating terminal 7 and transmits a high-voltage current. At this time, the locking arm 6 is in a horizontal state, the operational key 66 and the two springs 67 are all in initial positions, and the buckling portion 61 fastens the latch portion 922, thereby implementing the locking of the first connector 200 and the second connector 300. The two first position limiting portions 62 are respectively accommodated in the two sliding slots 926.

Figure 7:
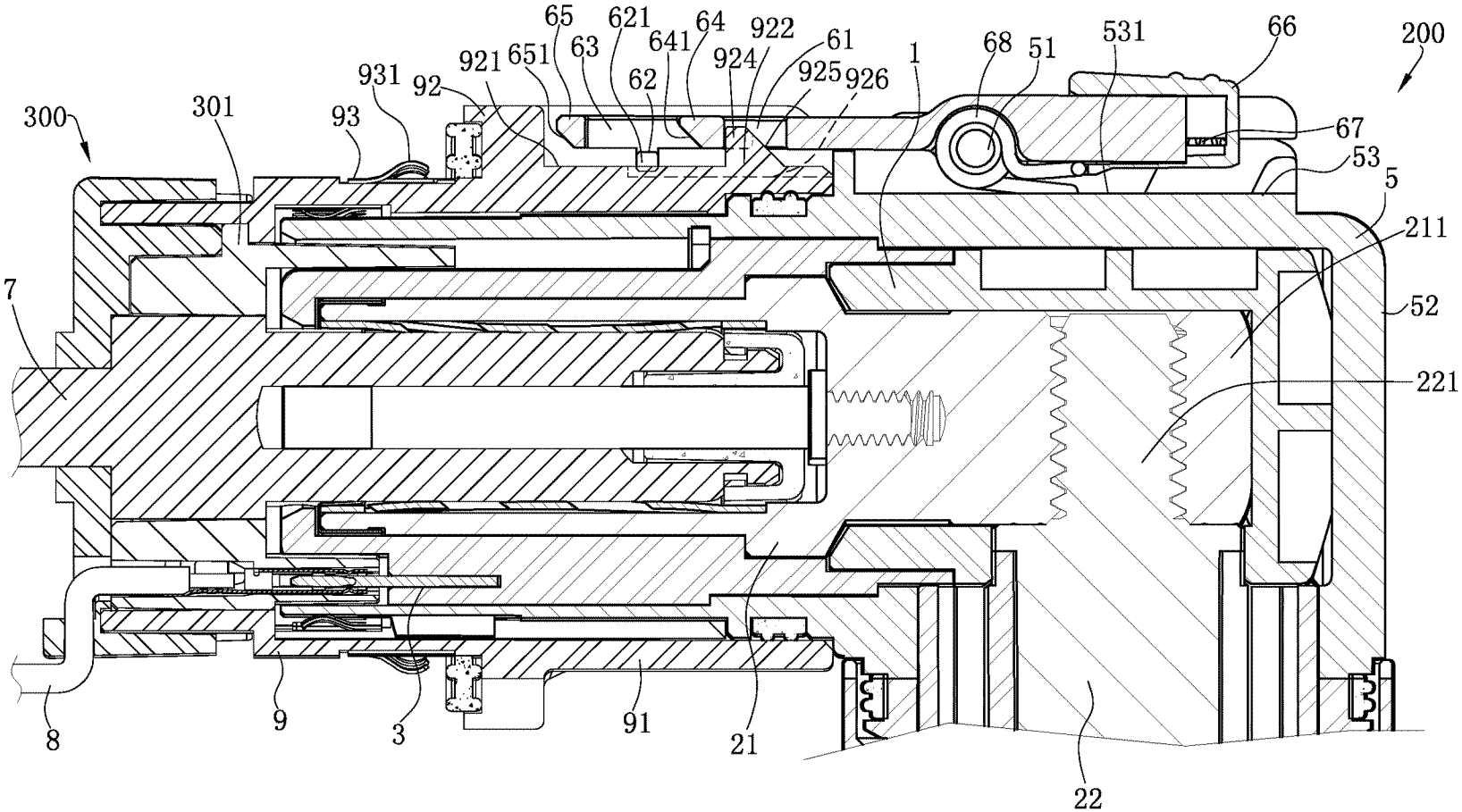
FIG. 7 is a partial sectional view of the electrical connector assembly according to the first embodiment of the present invention, where the operational key moves forward when the first connector and the second connector are separated.
Figure 8:
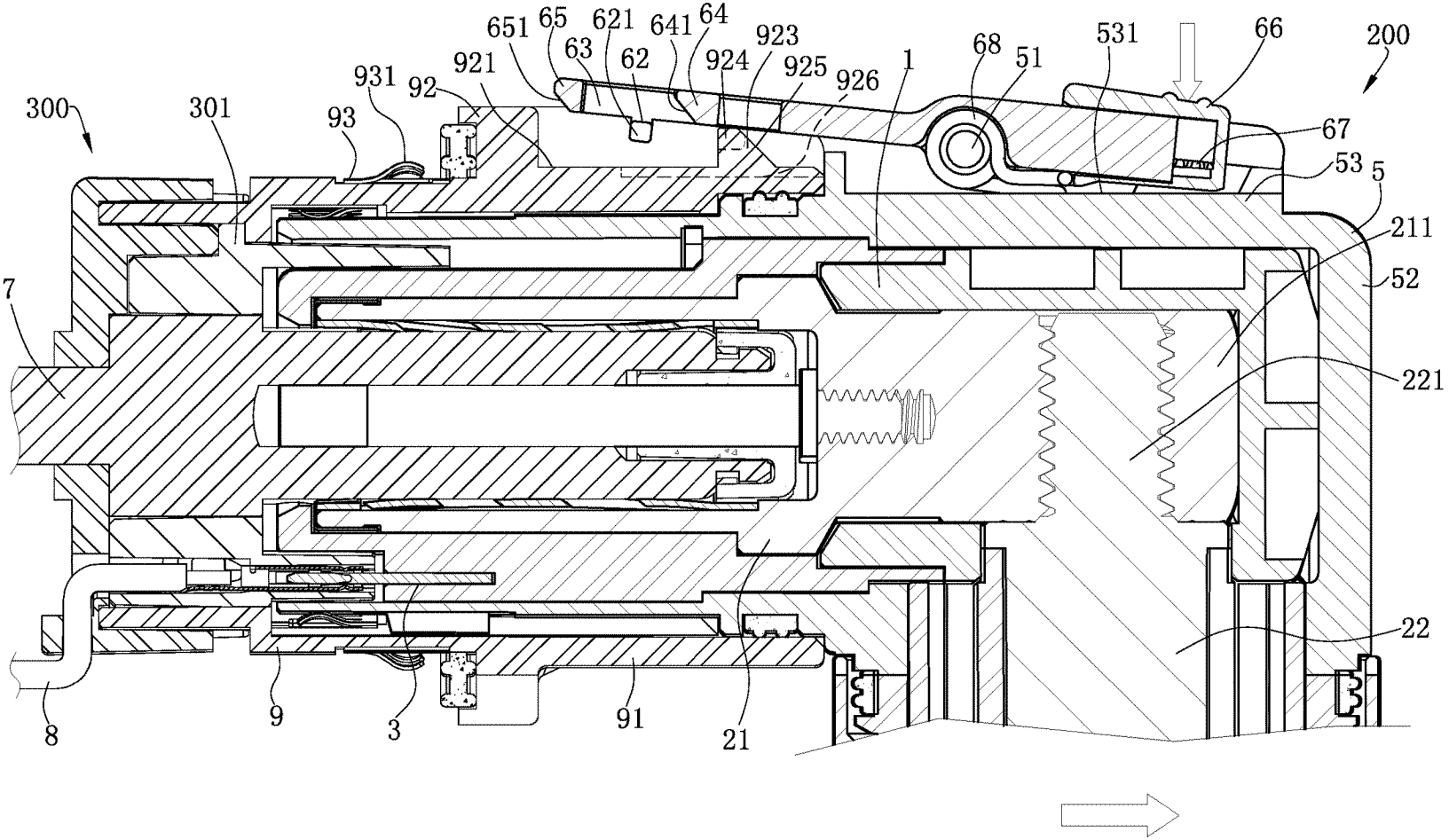
FIG. 8 is a partial sectional view of the electrical connector assembly according to the first embodiment of the present invention, where a buckling portion is detached upward from a latch portion when the first connector and the second connector are separated.

As shown in FIG. 7 and FIG. 8, when there is a need to separate the first connector 200 from the second connector 300, the locking arm 6 must be detached from the latch portion 922. The operator firstly pushes the operational key 66 forward from the position of the pressing surface (not shown in the drawings). At this time, the two springs 67 are in the compressed state. Then, the operational key 66 is actuated downward, such that the back end of the locking arm 6 rotates downward. By means of the lever principle, the front end of the locking arm 6 moves upward until the buckling portion 61 is upward detached from the latch portion 922. At this time, the terminal 2 is connected with the mating terminal 7, and the detection sheet 3 is connected with the signal wire 8.

Figure 9:
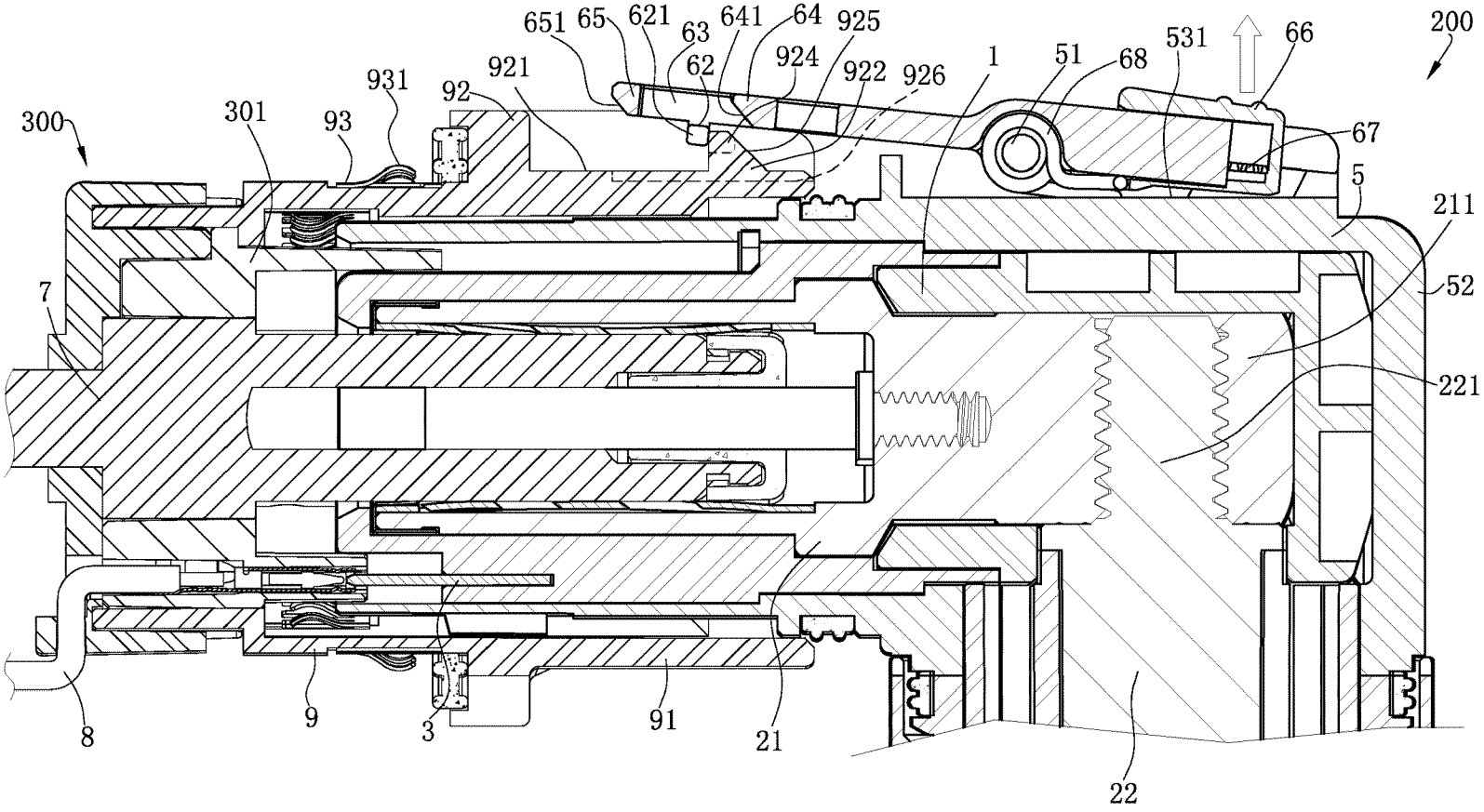
FIG. 9 is a partial sectional view of the electrical connector assembly according to the first embodiment of the present invention, where a stopping portion stops an engaging block when the first connector and the second connector are separated.

As shown in FIG. 9, the first connector 200 moves backward. As the front end of the locking arm 6 moves upward, the heights of the two first position limiting portions 62 reaches the corresponding heights of the two stopping portions 924, and the two stopping portions 924 stop the two engaging blocks 621, such that the first connector 200 temporarily does not continue moving backward. The first connector 200 and the second connector 300 are in a second locking position. At this time, the detection sheet 3 is separated from the signal wire 8. The contact area of the terminal 2 and the mating terminal 7 gradually decreases, but the terminal 2 and the mating terminal 7 are still in a mated state. The control equipment receives a power cut signal of the signal wire 8, and starts to perform a power cut action on the mating terminal 7.

As shown in FIG. 10, in order to allow the first position limiting portions 62 to detach from the latch portion 922, the operator must release the pressure for actuating the operational key 66 downward. The front end of the locking arm 6 pivots downward by the aid of the elastic restoring force of the torsion spring 68, such that the locking arm 6 restores to the horizontal state, and the operational key 66 restores to the initial position. The two engaging blocks 621 descend to be below the two stopping portions 924, such that the first position limiting portions 62 are detached from the latch portion 922. At this time, the terminal 2 and the mating terminal 7 are in a connected state, and the detection sheet 3 the signal wire 8 are in a disconnected state.

As shown in FIG. 11, the first connector 200 continuously moves backward. Since the distance c between the two engaging blocks 621 is greater than the width a of the main body portion, the two engaging blocks 621 pass below the two stopping portions 924 until the second beam 65 is stopped by the latch portion 922. Due to the elasticity action of the torsion spring 68, the locking arm 6 is in the horizontal state, and the second position limiting portion 63 is buckled with the latch portion 922. At this time, the first connector 200 and the second connector 300 are in a third locking position. In this moving process, the detection sheet 3 and the signal wire 8 are in a disconnected state, and the terminal 2 and the mating terminal 7 are still in the connected state.

Figure 12:
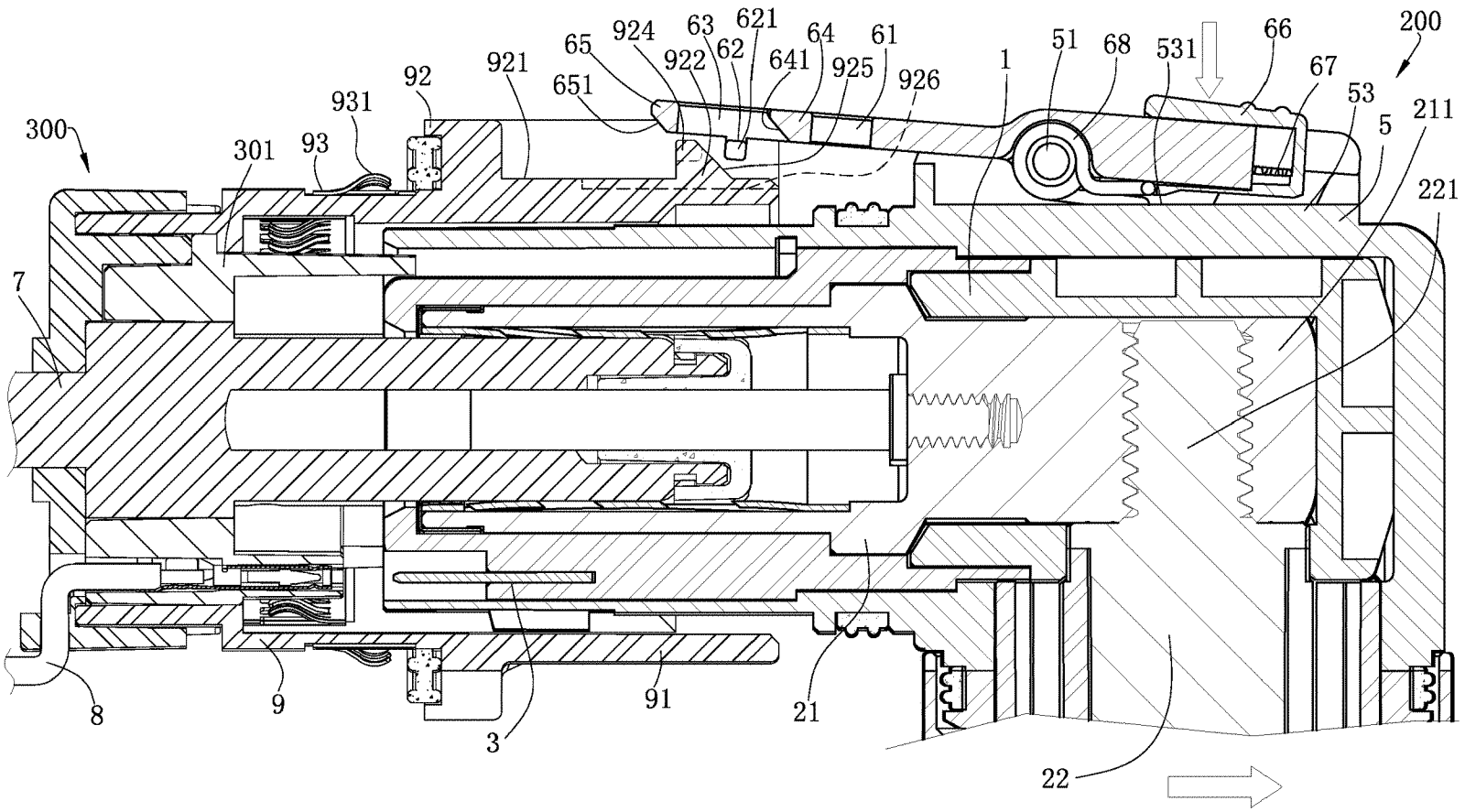
FIG. 12 is a partial sectional view of the electrical connector assembly according to the first embodiment of the present invention, where the second position limiting portion is detached upward from the latch portion when the first connector and the second connector are separated.

As shown in FIG. 12, in order to allow the second position limiting portion 63 to detach from the latch portion 922, the operator actuates the operational key 66 again to press downward the back end of the locking arm 6, and the front end of the locking arm 6 pivots upward, such that the second position limiting portion 63 moves upward to be above the latch portion 922. Then the first connector 200 is pulled backward again, and the second position limiting portion 63 passes above the latch portion 922 until the terminal 2 is completely disconnected from the mating terminal 7. By this time, the first connector 200 is completely separated from the second connector 300.

When the first connector 200 and the second connector 300 move from the first locking position to the second locking position, the detection sheet 3 and the signal wire 8 are disconnected, and the control equipment receives the power cut signal from the signal wire 8 and starts to control the power cut of the butting terminal 7. In the moving process of the first connector 200 and the second connector 300 from the second locking position to the third locking position, the control equipment has sufficient reaction time to control the power cut of the mating terminal 7, thereby ensuring the mating terminal 7 to be separated from the terminal 2 without electricity in the separation process of the first connector 200 and the second connector 300, avoiding the risk of the generation of the high-voltage arc by the mating terminal 7 and the terminal 2, and enhancing the usage safety of the electrical connector assembly 100.

The first connector 200 and the second connector 300 are installed in an enclosure of a vehicle. In the separation process of the first connector 200 and the second connector 300, the first connector 200 moves from the first locking position to the second locking position, and then moves from the second locking position to the third locking position, thereby limiting the movement of the first connector 200, such that the strokes of the two movements of the first connectors 200 are short, reducing an operating space for the operator, and allowing the operator to operate in the limited space of the vehicle. Further, the first connector 200 stops twice in the separation process from the second connector 300, thus effectively reducing the pulling force that the operator plugs the first connector 200 out, preventing the operator from injuries due to an excessive pulling force, and ensuring the operation safety of the operator.

Figure 14:
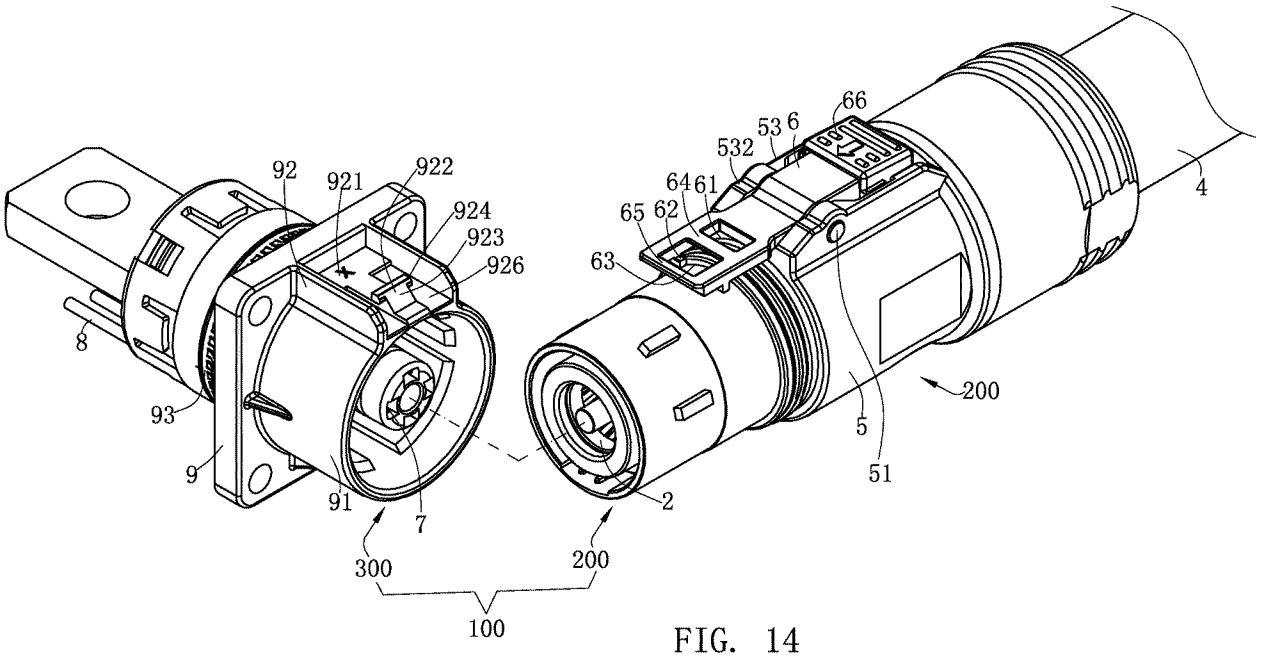
FIG. 14 is a perspective view of an electrical connector assembly according to a second embodiment of the present invention, before a first connector and a second connector are mated.

FIG. 14 shows an electrical connector assembly 100 according to a second embodiment of the present invention. The difference between this embodiment and the first embodiment exists in that: the first connector 200 is in a straight head state, and is not provided with an elbow. The remaining structures and functions are identical to those in the first embodiment, and are not elaborated herein.

To sum up, the electrical connector assembly according to certain embodiments of the present invention has the following beneficial effects:

(1) In the separation process of the first connector 200 and the second connector 300, the operational key 66 is actuated downward, the front end of the locking arm 6 moves upward, the buckling portion 61 is upward detached from the latch portion 922 and moves backward, and the latch portion 922 firstly stops the first position limiting portion 62 from moving backward. The operational key 66 is released, and by the aid of the elastic restoring forces of the torsion spring 68 and the springs 67, the front end of the locking arm 6 moves downward, and the first position limiting portions 62 are detached from the latch portion 922. The first connector 200 continuously moves backward, and the latch portion 922 stops the second position limiting portion 63 from moving backward, thereby avoiding the quick separation of the first connector 200 and the second connector 300 after the locking arm 6 is detached from the first stopping portion 924, ensuring the control equipment to have sufficient time to receive the power cut signal of the signal wire 8 and control the power cut of the terminal 2 and the mating terminal 7, enhancing the working stability of the control equipment, further ensuring the terminal 2 and the mating terminal 7 to be in the no-current state when the first connector 200 is completely separated from the second connector 300, and avoiding the risk of the generation of the high-voltage arc by the electrical connector assembly 100.

(2) The second position limiting portion 63 is a closed buckling slot. In the separation process of the first connector 200 and the second connector 300, if the first position limiting portions 62 are damaged or fail, the second position limiting portion 63 can perform a forced stopping function, thereby ensuring the terminal 2 to be separated from the mating terminal 7 without electricity, and enhancing the safety performance of the electrical connector assembly 100.

(3) The locking arm 6 is provided with the first beam 64 and second beam 65. The bottoms of the first beam 64 and the second beam 65 are respectively provided with the first inclined surface 641 and the second inclined surface 651, and the back end of the latch portion 922 is provided with the guiding inclined surface 925 which gradually tilts downward from front to back for mating with the first inclined surface 641 and second inclined surface 651. When the first connector 200 is to be inserted into the second connector 300, the front end of the locking arm 6 can gradually move upward along the guiding inclined surface 925, such that the first connector 200 can be quickly inserted into the second connector 300.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector assembly, comprising:

a first connector; and a second connector inserted to a front of the first connector, wherein:

the second connector has a casing, and a latch portion is protrudingly provided above the casing;

the first connector comprises a shell, a pivoting portion is disposed on the shell, a locking arm is pivoted to the shell by the pivoting portion, the locking arm is provided with a buckling portion in front of the pivoting portion, the latch portion is buckled with the buckling portion, and the locking arm comprises at least one first position limiting portion and a second position limiting portion in front of the buckling portion; and in a separation process of the first connector and the second connector, the locking arm is actuated, the buckling portion is detached from the latch portion and moves backward, and the latch portion firstly stops the first position limiting portion; and after the latch portion is detached from the first position limiting portion, the latch portion stops the second position limiting portion from moving backward.

2. The electrical connector assembly of claim 1, wherein in a vertical direction, the first position limiting portion is positioned below the second position limiting portion.

3. The electrical connector assembly of claim 1, wherein the buckling portion is a buckling slot on the locking arm, the second position limiting portion is another buckling slot provided in front of the buckling portion, a first beam is provided between the buckling portion and the second position limiting portion, and a second beam is provided at a front end of the second position limiting portion.

4. The electrical connector assembly of claim 3, wherein:

the locking arm protrudingly extends downward from a left side and a right side of the second position limiting portion to form two first position limiting portions;

in a front-rear direction, the two first position limiting portions are located between the first beam and the second beam; and the two first position limiting portions respectively have engaging blocks protrudingly extend toward each other, and in the separation process of the first connector and the second connector, the latch portion stops the two engaging blocks.

5. The electrical connector assembly of claim 4, wherein projections of the two engaging blocks along a vertical direction overlap with a projection of the second position limiting portion along the vertical direction.

6. The electrical connector assembly of claim 4, wherein the latch portion comprises a main body portion and two stopping portions extending symmetrically from two sides of the main body portion, and in the separation process of the first connector and the second connector, the two stopping portions respectively stop the two engaging blocks.

7. The electrical connector assembly of claim 6, wherein in a left-right direction, a width of the main body portion is less than a distance between the two engaging blocks, and a distance between the two stopping portions is greater than the distance between the two engaging blocks.

8. The electrical connector assembly of claim 6, wherein a top end of the main body portion is flush with top ends of the two stopping portions.

9. The electrical connector assembly of claim 6, wherein the casing is concavely provided with two sliding slots respectively at a left side and a right side of the main body portion, the two sliding slots extend to a back end surface of the casing, and the two stopping portions are respectively located above the two sliding slots.

10. The electrical connector assembly of claim 3, wherein a bottom of each of the first beam and the second beam has an inclined surface gradually tilting downward from front to back, and a top of the latch portion is provided with at least one guiding inclined surface gradually tilting downward from front to back.

11. The electrical connector assembly of claim 1, wherein an operational key is installed at a back end of the locking arm, at least one spring is fastened between the operational key and the locking arm, and a torsion spring is sleeved over the pivoting portion and simultaneously abuts the locking arm and the shell.

12. The electrical connector assembly of claim 1, wherein a shielding ring is sleeved over the casing, the shielding ring is provided with a plurality of holes and a plurality of elastic sheets, and the elastic sheets are extended radially outward to abut an external member.

13. The electrical connector assembly of claim 1, wherein the second position limiting portion and the buckling portion are located on a same horizontal plane.

* * * * *